United States Patent [19]

Yamaguchi et al.

[11] Patent Number: 4,789,357

[45] Date of Patent: Dec. 6, 1988

[54] ELECTRICAL CONNECTOR SHIELD CASE

[75] Inventors: Masao Yamaguchi; Kimio Teramura, both of Tokyo, Japan

[73] Assignee: Hirose Electric Co., Ltd., Tokyo, Japan

[21] Appl. No.: 69,402

[22] Filed: Jul. 2, 1987

[30] Foreign Application Priority Data

Jul. 15, 1986 [JP] Japan ..... 61-164574

[51] Int. Cl.[4] ..... H01R 13/658

[52] U.S. Cl. ..... 439/607; 439/901

[58] Field of Search ..... 439/607-610, 439/901

[56] References Cited

U.S. PATENT DOCUMENTS

| | | | |
|---|---|---|---|
| 3,036,145 | 5/1962 | Murphy | 439/607 |
| 4,371,226 | 2/1983 | Brancaleone | 439/608 |
| 4,415,223 | 11/1983 | Asick | 439/610 |
| 4,685,758 | 8/1987 | Yoshida | 439/607 |
| 4,687,263 | 8/1987 | Cosmos et al. | 439/607 |
| 4,718,866 | 1/1988 | Yamaguchi | 439/607 |

*Primary Examiner*—Neil Abrams

*Attorney, Agent, or Firm*—Takeuchi Patent Office

[57] ABSTRACT

An electrical connector shield case for enclosing an insulation member having a plurality of contacts, which comprises a cylindrical member made by bending a metal piece so as to enclose said insulation member; and said cylindrical member having locking means on opposite ends of said metal piece so as to prevent opening of said cylindrical member.

6 Claims, 5 Drawing Sheets

FIG. 1
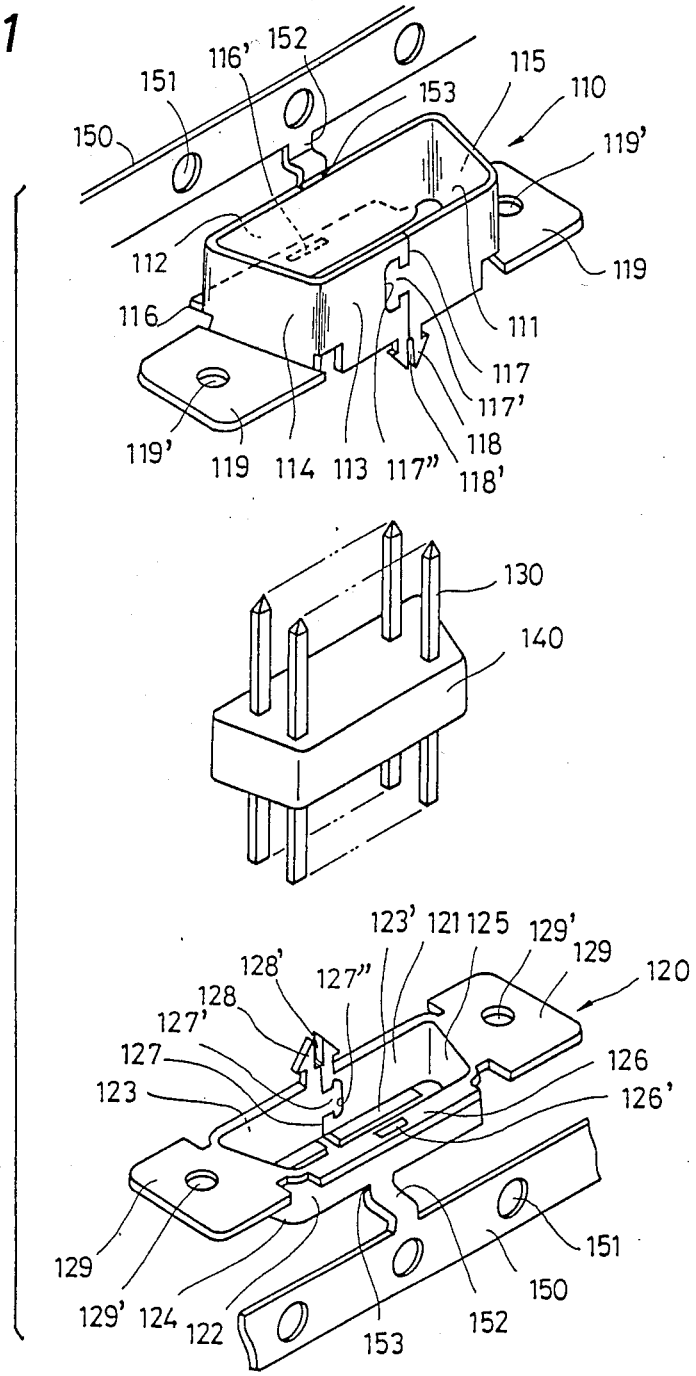
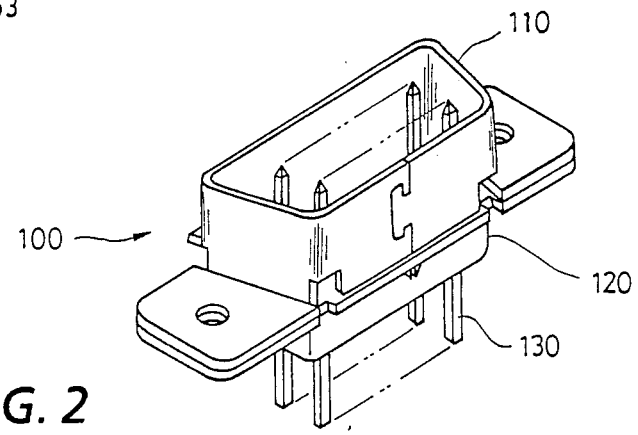
FIG. 2

ELECTRICAL CONNECTOR SHIELD CASE

BACKGROUND OF THE INVENTION

1. Field of the Invention

The present invention relates generally to electrical connector shield cases, especially to an electrical connector shield case for enclosing the insulation member of a plug connector or receptacle.

2. Description of the Prior Art

FIGS. 8 and 9 show a conventional electrical connector shield case consisting of front and rear case sections 10 and 20. The front or rear case section has a cylindrical shell 13 or 23 and a transverse flange 11 or 21. These case sections 10 and 20 are joined together by putting the transverse flanges 11 and 21 together with screws, for example, to enclose an insulation block 40 on which male contacts 30 are planted.

These shield case sections 10 and 20 have been made of a sheet of metal. A method of making the front shield case section 10 will described with reference to FIGS. 10A through 10E.

(1) As FIG. 10A shows, a rectangular piece of metal 10A sufficiently large to meet the size of a final product or front case section 10 such as shown in FIG. 8 is prepared.

(2) As FIGS. 10B and 10C show, a lower die 50 with a protuberance 51 having a section similar to that of the shell 12 is pushed upwardly into an upper die 60 with a depression 61 to draw a case element 10B having a crown portion 11B and a brim portion 12B such as shown in FIG. 10D.

(3) As FIG. 10E shows, a lower die 70 with a protuberance 71 having a section similar to that of the crown 11B and a depression 72 corresponding to the periphery of the flange 11 of the front case section 10 and an upper die 80 with a depression 81 having a section similar to that of the crown 11B and a protuberance 82 corresponding to the periphery of the flange 11 of the front case section 10 are relatively moved toward each other to form an opening 13 on the top of the crown 11B and the desired flange 11 as shown in FIG. 8.

(4) As FIG. 11 shows, a plurality of front case sections 10 are hung from a hanger 92 and dipped in the plating liquid 91 of a plating tank 90 for plating. The rear case section 20 may be made in the substantially same manner as that of the front case section 10 and its description will be omitted.

As FIG. 8 shows, the insulation block 40 is placed between the front and rear case sections, fitted into the opening 23 of the rear case section 20 and then covered by the front case section 10. The front and rear case sections 10 and 20 are put together by inserting a pair of studs 24' with a through hole 24 through a pair of apertures 14 in the front flange 11 and deforming them (FIG. 9).

The above electrical connector shield case, however, has the following shortcomings.

(1) The above drawing process reduces the yield of a metal sheet and increases the material cost.

(2) The respective steps of the above manufacturing process are completely separated and are difficult to use in a continuous production line, thus increasing the unit manufacturing cost.

(3) The drawing process requires a soft and extensible metal, putting a limit on the range of choices in material and pushing up the unit manufacturing cost. The soft material is also liable to deformation by an external force.

(4) The height of a shell drawn is so large that the thickness of the shield case becomes uneven, thus reducing the product precision.

(5) In order to make a good shield contact between two connectors, it is often necessary to make some projections on the outside or inside of the case surface. These projections are very difficult to make by drawing.

(6) For plating, each case has been hung manually on the hanger, reducing the production efficiency and increasing the unit manufacturing cost.

(7) For assembly of a shield case around an insulation block has been made manually and is very difficult to mechanize, increasing the unit manufacturing cost. This manual operation also brings about a dispersion in the product quality.

SUMMARY OF THE INVENTION

It is an object of an invention to provide an electrical connector shield case which is free from the aforementioned problems.

It is another object of the invention to provide a method of making such an electrical connector shield case.

According to one aspect of the invention there is provided an electrical connector shield case for enclosing an insulation member having a plurality of contacts, which comprises a cylindrical member made by bending a metal piece so as to enclose said insulation member; and said cylindrical member having locking means on opposite ends of said metal piece so as to prevent opening of said cyclindrical member.

According to another aspect of the invention there is provided an electrical connector shield case for enclosing an insulation member, which comprises an first case section with a first cylindrical member made by bending a first metal piece so as to enclose said insulation member; a second case section with a second cylindrical member made by bending a second metal piece so as to enclose said insulation member in cooperation with said first cylindrical member; opposite ends of each of said first and second metal pieces have locking means for engaging each other to prevent opening of each of said first and second cylindrical members; and said first and second case sections have fastener means for joining said first and second case sections together so as to enclose said insulation member.

According to still another aspect of the invention there is provided a method of making an electrical connector shield case for enclosing an insulation member with a plurality of contacts, which comprises the steps of stamping out of a metal sheet at least one profiled metal piece with locking means at its opposite ends; and bending said metal piece in such a manner that said locking means may engage each other to form a cylindrical member for enclosing said insulation member.

Other objects, features, and advantages of the present invention will be apparent from the following description taken in conjunction with the accompanying drawings.

BRIEF DESCRIPTION OF THE DRAWINGS

FIG. 1 is an exploded perspective view of an electrical connector shield case before assembly.

FIG. 2 is a perspective view of the assembled electrical connector shield case according to the present invention.

DESCRIPTION OF THE PREFERRED EMBODIMENTS

Figure 4A:
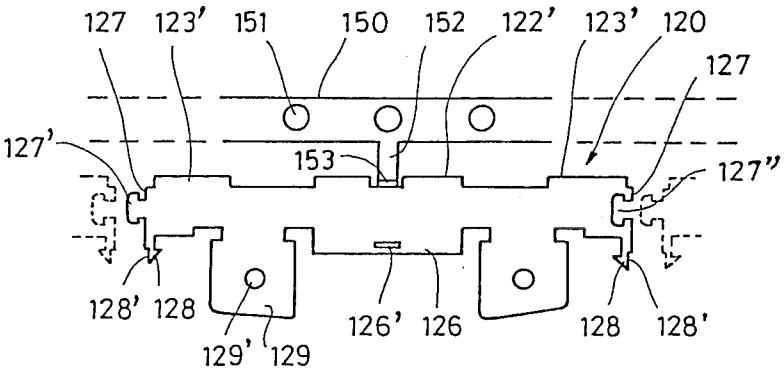
FIG. 4A is an elevational view of the flat rear case section of FIG. 1.

Referring now to FIGS. 1 and 2 there is shown an electrical connector shield case 100 consisting of front and rear case sections 110 and 120 for enclosing an insulation block 140.

The front case section 110 has a pair of major sides 112 and 113 and a pair of minor sides 114 and 115 for defining a cylindrical enclosure 111 having a trapezoidal section. The major side 112 is integral with a transverse flange 116 having a fastener slot 116' for receiving a spearhead-shaped fastener tab 128 of the rear case section 120. These fastener tab 128 and slot 116' constitute fastener means. A crank-shaped link 152 connects the upper center of the major side 112 to a carrying strip 150 which is moved by an automatic assembler (not shown). The link 152 has a notch 153 for facilitating separation of the front case section 110 from the carrying strip 150.

A pair of opposite ends 117 are joined at the center of the other major side 113, with a locking tab 117' of one of the ends engaged with a locking recess 117'' of the other end. The major side 113 has on its central lower edge a spearhead-shaped fastener tab 118 with a slit 118'. This fastener tab 118 is fitted into a fastener slot 126' provided in a transverse flange 126 of the rear case section 120 not only to prevent separation of the ends 117 and but to join the front and rear case sections together. The minor sides 114 or 115 is integral with a mounting flange 119 with a mounting aperture 119'.

The rear case section 120 has a pair of major sides 122 and 123 and a pair of minor sides 124 and 125 for defining a cylindrical enclosure 121 having a trapezoidal section. The major side 122 is integral with the transverse flange 126 having a fastener slot 126' for receiving the fastener tab 118 of the front case section 110. A crank-shaped link 152 connects the lower central portion of the major side 122 to a carrying strip 150 which is moved by an automatic assembler (not shown). The link has a notch 153 for facilitating separation of the rear case section 120 from the carrying strip 150.

A pair of opposite ends 127 are joined together at the center of the other major side 123, with a locking tab 127' of one of the ends engaged with a locking recess 127'' of the other end. The major side 123 has at its upper cental poriton a spearhead-like fastener tab 128 with a slit 128'. Its insertion into the locking slot 116' of the front case section 110 not only prevents separation of the ends 127 but also joins the front and rear case sections 110 and 120 together. The minor side 124 or 125 is integral with a mounting flange 129 having a mounting aperture 129'. The major sides 122 and 123 have along their lower edge supporting flanges 123' extending inward in a plane normal to the sides for supporting the insulation block 140.

Such a shield case as described above may be made by the following method.

(1) A metal sheet (hoop) with dimensions appropriate to the size of the front and rear case sections 110 and 120 is prepared.

Figure 3A:
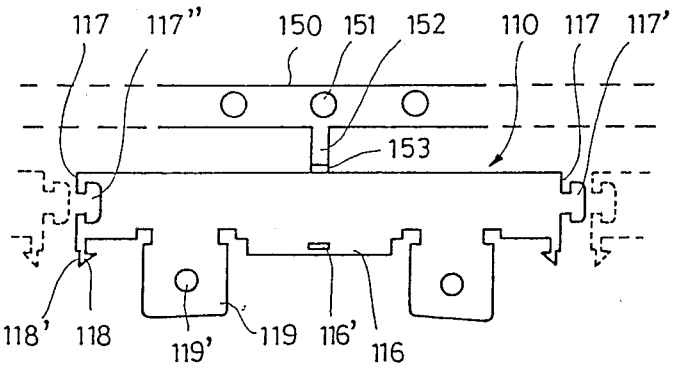
FIG. 3A is an elevational view of the flat front section of FIG. 1.

(2) As FIGS. 3A and 4A show, unfolded flat front and rear case sections are stamped out of the metal sheet in succession. A large number of flat case sections 110 or 120 are linked to the carrying strip 150.

Figure 4B:
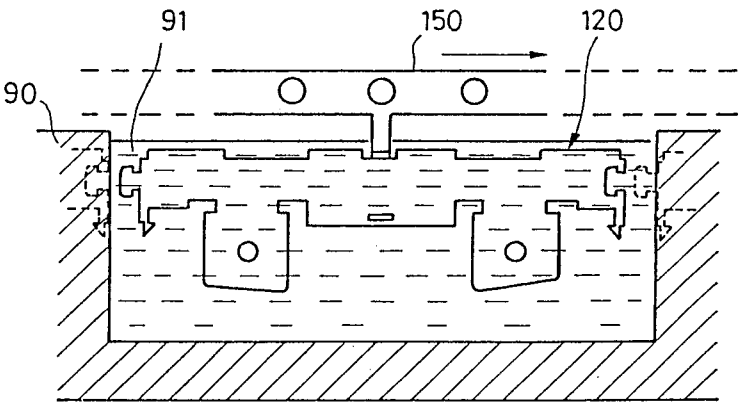
FIG. 4B is an elevational view of the rear section in a plating bath.
Figure 3B:
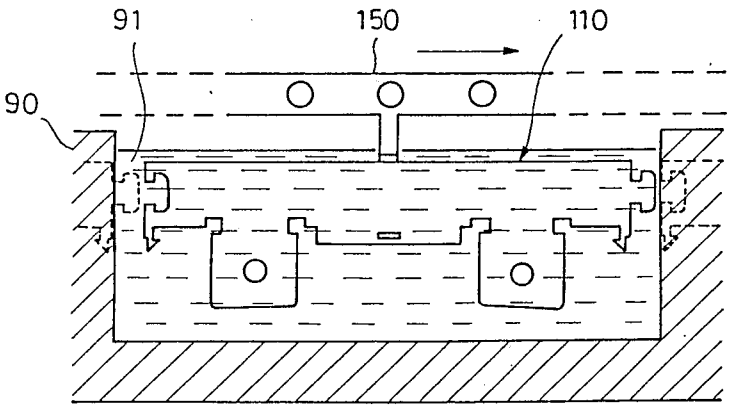
FIG. 3B is an elevational view of the front case section in a plating bath.

(3) As FIGS. 3B and 4B show, the flat case sections 110 or 120 linked to the carrying strip 150 are continuously moved and dipped in the plating liquid 91 of a plating tank 90 for plating. Alternatively, this plating step may be made after the next folding step or before the above stamping step.

(4) The front and rear case sections 110 and 120 are then folded into substantially cylindrical forms such as shown in FIG. 1 by means of a press. At this point, each locking tab 117' is fitted into the locking recess 117'' to join the opposite ends together.

(5) The front case section 110, the insulation block 140 with contacts 130, and the rear case section 120 are then arranged as shown in FIG. 1. After the insulation block 140 is put in the enclosure 121 of the rear case section 120, either the front case section 110 is lowered or the rear case section 120 is raised so that the locking tabs 118 and 128 of the front and rear case sections 110 and 120 may be inserted into the corresponding locking slots 126 and 116 of the front and rear case sections 120 and 110, respectively. As a result, the front and rear case sections 110 and 120 are joined together to house the insulation block 140 between them and secure connection of the opposite ends 117 and 127. This completes the assembly of an electrical connector shield case 100 (FIG. 2).

Figure 5:
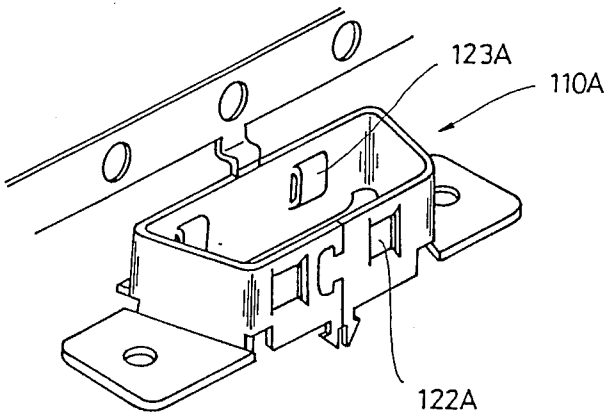
FIG. 5 is a perspective view of the front case section of another shield case according to the invention.
Figure 9:
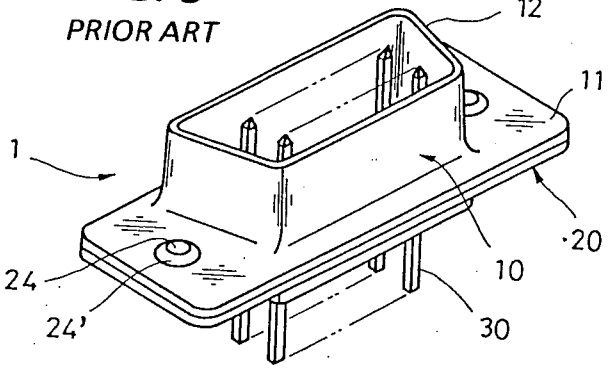
FIG. 9 PRIOR ART
FIG. 9 is the assembled shield case according to the prior art.
Figure 8:
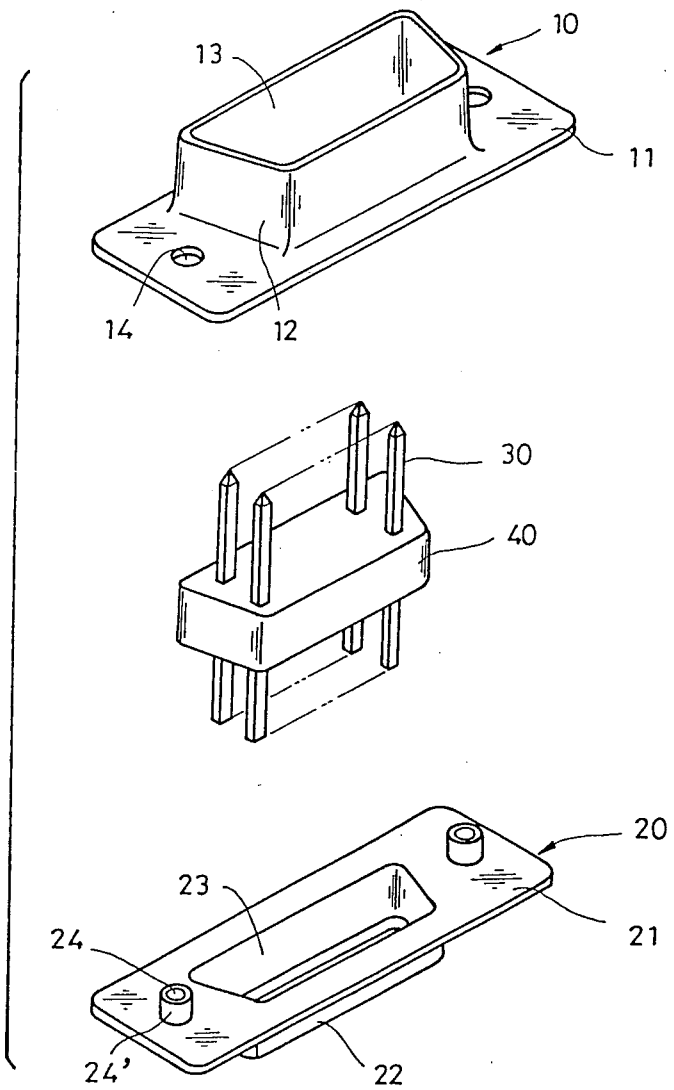
FIG. 8 PRIOR ART
FIG. 8 is an exploded perspective view of a conventional electrical connector shield case.

FIG. 5 shows another front case section embodying the present invention. Recently, some shield cases have springy protuberances on their sides to make a firm contact with the mating connector in order to prevent radio wave troubles. These protuberances are very difficult to make on the shield case surfaces by the drawing process, thus increasing the product cost.

However, according to the invention, springy bosses 122A and 123A may be made very easily in the stamping step of a metal sheet before the stamped metal piece is folded to make a cylindrical enclosure. These bossess 122A and 123A assure a firm contact with the mating shield case so as to prevent radio wave troubles.

Figure 6:
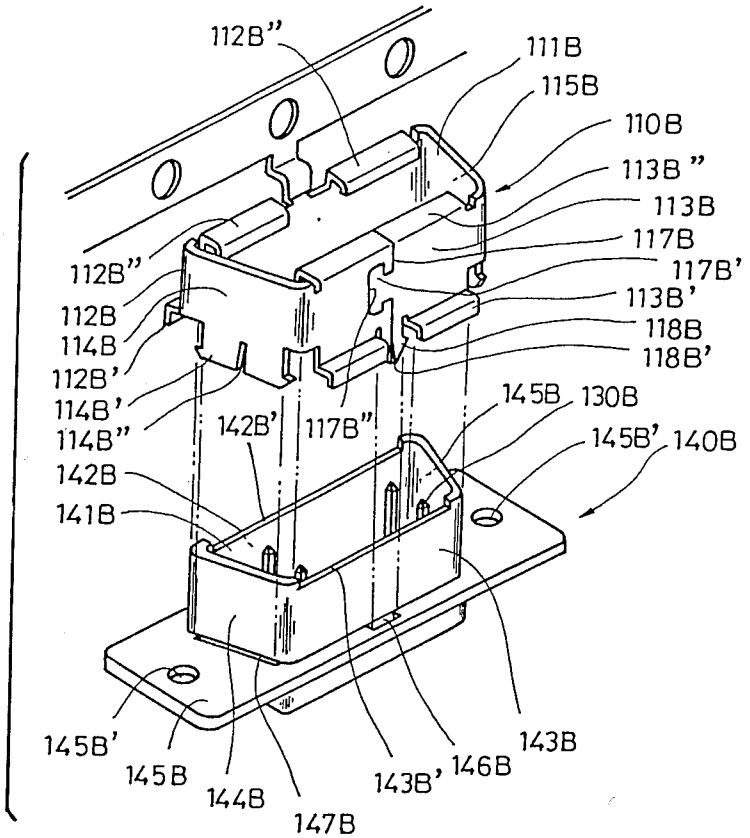
FIG. 6 is an exploded perspective view of a still another shield case according to the invention.

FIG. 6 shows still another shield case embodying the present invention. This third embodiment is different from the above two embodiments in that it consists of only a single shield case section for enclosing the insulation housing 140B. The shield case 110B has a pair of major sides 112B and 113B and a pair of minor sides 114B and 115B for defining a cylindrical enclosure 111B having a trapezoidal section. The major side 112B or 113B has a spearhead-shaped fastener tab 118B to be inserted into a fastener slot 146B of the insulation housing 140B. Preferably, the fastener tab has a slit 118B' for springy engagement with the slot 146B. It also has a pair of L-section flanges 112B' or 113B' along its rear edge on either side of the fastener tab 118B and a pair of U-section flanges 112B" or 113B" along its front edge.

Opposite ends 117B are joined together at the center of the major side 113B, with a T-shaped locking tab 117B' of one end fitted into a T-shaped locking recess 117B" of the other end to prevent separation of the ends. The minor sides 114B or 115B has a fastener tab 114B' to be inserted into a fastener slot 147B provided in the flange 145B of the insulation housing 140B. The fastener tab 114B has a slit 114B" for providing spring property.

The insulation housing 140B has a pair of major sides 142B and 143B and a pair of minor sides 144B and 145B for defining a space 141B having a trapezoidal section within which a plurality of male contacts 130B are arranged. The mjor side 142B or 143B has at its front edge a cut 142B' or 143B' for receiving the U-section flanges 112B" or 113B". The major and minor sides are integral with a peripheral flange 145B having the fastener slots 146B along the major sides 142B and 143B for receiving the fastener tabs 118B and fastener slots 147B along the minor sides 144B and 145B for receiving the fastener tabs 114B'. The peripheral flange 145B further has a pair of mounting apertures 145B' for securing the connector to a panel or the like.

Figure 7A:
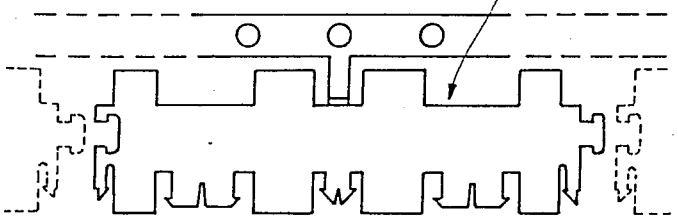
FIG. 7A is an elevational view of a stamped flat shield case of FIG. 6.
Figure 7B:
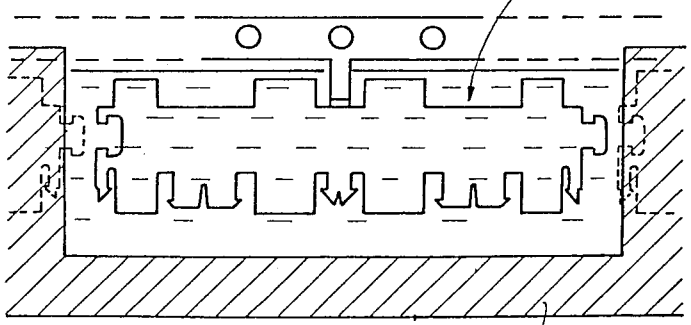
FIG. 7B is an elevational view of the flat shield case of FIG. 6 in a plating bath.
Figure 10A:
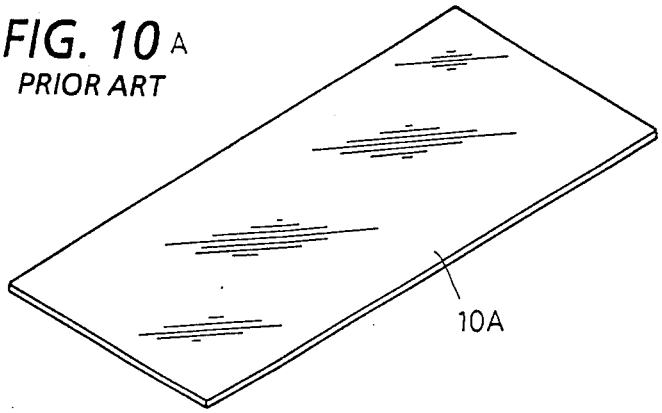
FIG. 10 A PRIOR ART
FIG. 10A through 10E illustrates the manufacturing process of the conventional shiled case of FIG. 9.
Figure 10B:
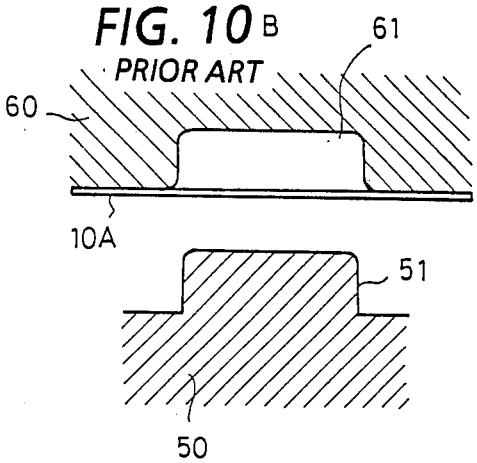
FIG. 10 B PRIOR ART
Figure 10C:
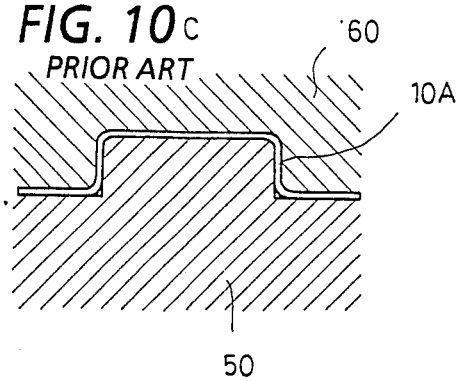
FIG. 10 C PRIOR ART
Figure 10D:
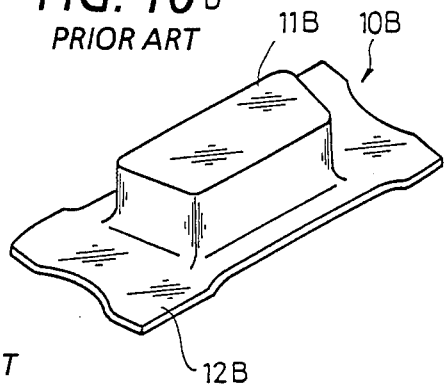
FIG. 10 D PRIOR ART
Figure 10:
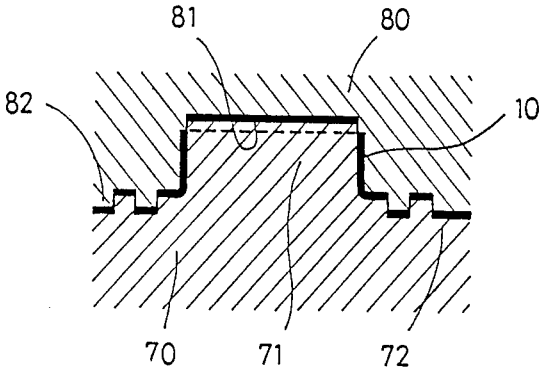
FIG. 10 E PRIOR ART
Figure 11:
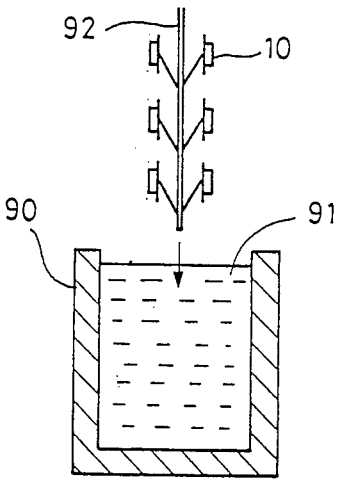
FIG. 11 PRIOR ART
FIG. 11 shows how to plate the conventional shield cases.

As FIGS. 7A and 7B show, the method of making the shield case 110B is substantially the same as that of the first embodiment and its description will be omitted. The shield case 110B may be easily assembled over the insulation housing 140B by placing the shield case and insulation housing in an automatic assembler (not shown) as shown in FIG. 6 and moving them relative to each other. Thus, a large number of shield cases may be assembled at once. The contacts supported by the insulation housing are almost completely enclosed by the shield case, and the U-section flanges 112B" and 113B" make a springy contact with the mating connector shield case.

In the above embodiments, the union of the opposite ends of a shield case are made by means of the tab-and-recess locking means and the tab-and-slot fastener means, but it may be made by means of gluing, soldering, welding, deforming, or rivetting. The above insulation block or housing has male contacts but, of course, it may have female contacts.

According to the invention there are provided the following advantages.

(1) Since no drawing process is required, the yield of a metal sheet is increased and the material cost is reduced.

(2) The continuous automatic manufacture of shield cases and the continuous automatic assembly of electric connectors with such a shield case are possible, making the unit manufacturing cost much less than before.

(3) Since no drawing process is used, no soft and extensible meterial is required, thus increasing the range of material choices. Also, there is no or little deformation due to the process stress.

(4) Since no drawing process is used, the shield case has an even thickness in all parts, thus maintaining high product precision and quality.

(5) The springy protuberance for making a good shield contact with the mating connector may be easily made of springy metal.

(6) The connectors may be made in volume on a continuous assembly line from sheet material to final products with uniform quality at low cost.

While a preferred embodiment of the invention has been described above, such description is for illustrative purpose only, and it is to be understood that changes and variations may be made without departing from the spirit and scope of the invention as defined in the following claims.

What is claimed is:

1. An electrical connection shield case for enclosing an insulation housing having a vertical side wall surrounding a plurality of contacts, a horizontal flange integral with said vertical side wall, and first fastener means provided in said horizontal flange of said insulation housing, which comprises:

a cylindrical member made of a metal sheet, opposite free ends of which abut each other at a seam of said cylindrical member which fits over said vertical side wall of said insulation housing;

locking means provided on said opposite free ends to prevent opening of said cylindrical member; and second fastener means provided on a rear edge of said cylindrical member across said seam for engagement with said first fastener means, thereby preventing any offsetting, overlapping and separation of said opposite free ends.

2. The electrical connector shield case of claim 1, wherein said first and second fastener means are a slot and a spearhead-shaped tab, respectively.

3. The electrical connector shield case of claim 1, wherein said cylindrical member has a U-section flange on its front edge to fit over a top edge of said vertical side wall of said insulation housing.

4. An electrical connector shield case for enclosing an insulation member, which comprises:

a first case section with a first cylindrical member made of a first metal sheet, opposite first free ends of which abut each other at a first seam;

first locking means provided on said first free ends to prevent opening of said first cylindrical member;

first fastening means provided on a rear edge of said first cylindrical member across said first seam;

a second case section with a second cylindrical member made of a second metal sheet, opposite second free ends of which abut each other at a second seam;

second locking means provided on said second free ends to prevent opening of said second cylindrical member;

second fastening means provided in an area on a front edge of said second cylindrical member, in which said second seam is absent, for engagement with said first fastening means, thereby preventing offsetting, overlapping, and separation of said first free ends.

5. The electrical connector shield case of claim 4, wherein said first fastening means is formed in a spearhead shape and said second fastening means is a slot provided in a flange extending from said front edge of said second cylindrical member.

6. The electrical connector shield case of claim 4, wherein said first cylindrical member has at least one protuberance for making a spring contact with a mating connector shield case.

* * * * *